United States Patent [19]

Aizawa et al.

[11] 3,991,671

[45] Nov. 16, 1976

[54] DYNAMICALLY DRIVEN PRINTER

[75] Inventors: Susumu Aizawa, Suwa; Yoshikiyo Futagawa, Okaya; Katsumi Kuriya, Matsumoto, all of Japan

[73] Assignees: Kabushiki Kaisha Suwa Seikosha, Tokyo; Shinshu Seiki Kabushiki Kaisha, Suwa, both of Japan

[22] Filed: Apr. 21, 1975

[21] Appl. No.: 569,624

Related U.S. Application Data

[63] Continuation of Ser. No. 384,867, Aug. 1, 1973, abandoned.

[30] Foreign Application Priority Data

Aug. 2, 1972 Japan ..... 47-77417

[52] U.S. Cl. ..... 101/93.04; 197/1 R; 340/172.5; 346/76 R; 101/1

[51] Int. Cl.[2] ..... B41J 7/70

[58] Field of Search ..... 101/93.04, 93.05; 197/1 R; 340/172.5, 336; 346/141, 76, 139 R

[56] References Cited

UNITED STATES PATENTS

| | | | |
|---|---|---|---|
| 3,312,979 | 4/1967 | Della Torre et al. | 346/76 |
| 3,354,817 | 11/1967 | Sakurai et al. | 197/1 R X |
| 3,426,880 | 2/1969 | Blodgett | 101/93.05 X |
| 3,453,648 | 7/1969 | Steyenga | 346/76 |
| 3,690,431 | 9/1972 | Howard | 197/1 R |
| 3,812,466 | 5/1974 | Rich | 340/172.5 |
| R25,830 | 8/1965 | Shull | 101/93.04 |

OTHER PUBLICATIONS

Marcus, "Pointer or Display with Biased Switching", IBM Technical Disclosure Bulletin, vol. 12, No. 11, 4/70, p. 1913.

*Primary Examiner*—Edward M. Coven
*Attorney, Agent, or Firm*—Blum, Moscovitz, Friedman & Kaplan

[57] ABSTRACT

A dynamically driven printer is provided for printing the output of a device having a memory register, the printer including print means operable directly from said memory register without an intervening temporary memory register in a manner corresponding to the operation of a segmented digital electronic display. The operating periods of the print means and memory register need not be synchronized. The print means may include a plurality of segment printing devices at each digit position, corresponding segment printing devices at each digit position being coupled together for simultaneous receipt of driving signals generated in response to the output of the main memory register. Each of the digit positions is sequentially actuated to effect printing.

12 Claims, 6 Drawing Figures

DYNAMICALLY DRIVEN PRINTER

This is a continuation of application Ser. No. 384,867, filed Aug. 1, 1973, now abandoned.

BACKGROUND OF THE INVENTION

This invention relates to printing arrangements for devices having memory registors which repeat read and write functions periodically. Generally, there are two types of memory devices. The first is of the condenser memory type, wherein data is not retained unless the read and write functions are repeated periodically. The second type of memory device is of the magnetic core type, wherein once data is written, it can be retained until a rewrite signal is applied. The period of a memory register is the period of the periodic repeat of the read and write functions within the memory register, which period is generally controlled by functions within the device other than the display function, although synchronization with the display function is sometimes provided. For example, in an electronic computer, the "period" is the period of bits, figures or memory cycles which is read and written for the purposes of calculating. Generally, the clock of an electronic computer operates at from several to several hundred times as fast as a printer. For this reason, although a memory register for the purposes of calculation and/or display is generally provided within a computer, printing devices are generally not driven directly by the output signal of the memory register, since the conventional printing devices cannot respond to the reading and writing speed of the conventional memory register. Generally, conventional printers are driven indirectly by applying the contents of the memory register of the computer to another temporary memory register which can memorize the information until printing is completed. The contents of the temporary memory register are read out continuously until printing or selection of characters is completed. Such a driving method for a printer can be characterized as being indirect, inasmuch as the signals indentifying the characters to be printed are not directly applied by the memory register of the computer, but rather are applied through a second temporary memory register.

On the other hand, where electronic displays are utilized in conjunction with computers or similar devices, the electronic display is generally driven directly by the output of the main memory register. Such display devices, such as fluorescent display devices, may be driven by applying the contents of the main memory register for calculation directly to the display device at the calculating cycle of reading and writing utilizing the scanning method for driving the fluorescent display device, since the display device can operate at a speed sufficiently fast to respond to the clock or "period" of the computer. By providing a print device driven directly by the main memory register, as in the case of fluorescent display devices, the foregoing deficiencies in known printing devices are avoided.

SUMMARY OF THE INVENTION

Generally speaking, in accordance with the invention, a dynamically driven printer for use with a device having a main memory register is provided including print means and means for directly applying the output of said main memory register to said print means, said print means being adapted to effect printing in response to the signals applied thereto from said main memory register. The operating periods of the print means and memory register need not be synchronized. The print means may include a plurality of segment printing devices at each digit position, corresponding segment printing devices at each digit position being coupled together for simultaneous receipt of driving signals from said means interconnecting said main memory register and said print means. In such an embodiment, each of the digit positions would be sequentially actuated to effect printing. Examples of such print means include mechanical, thermo-sensitive, discharge, electrolytic, ink jet, ferromagnetic, electrostrictive and supersonic wave-type printers. All of said printers would be characterized by their ability to directly respond to the output of a main memory register which is read and written periodically.

Accordingly, the object of this invention is to provide a dynamically driven printer which can function directly from the output of a main memory register without the intervention of a temporary memory register.

Still another object of the invention is to provide a dynamically driven printer wherein the periods of the print means and the main memory register driving said print means need not be synchronized.

A further object of the invention is to provide a dynamically driven printer which is more economical and more efficient than the known printer devices.

Still other objects and advantages of the invention will in part be obvious and will in part be apparent from the specification and drawings.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
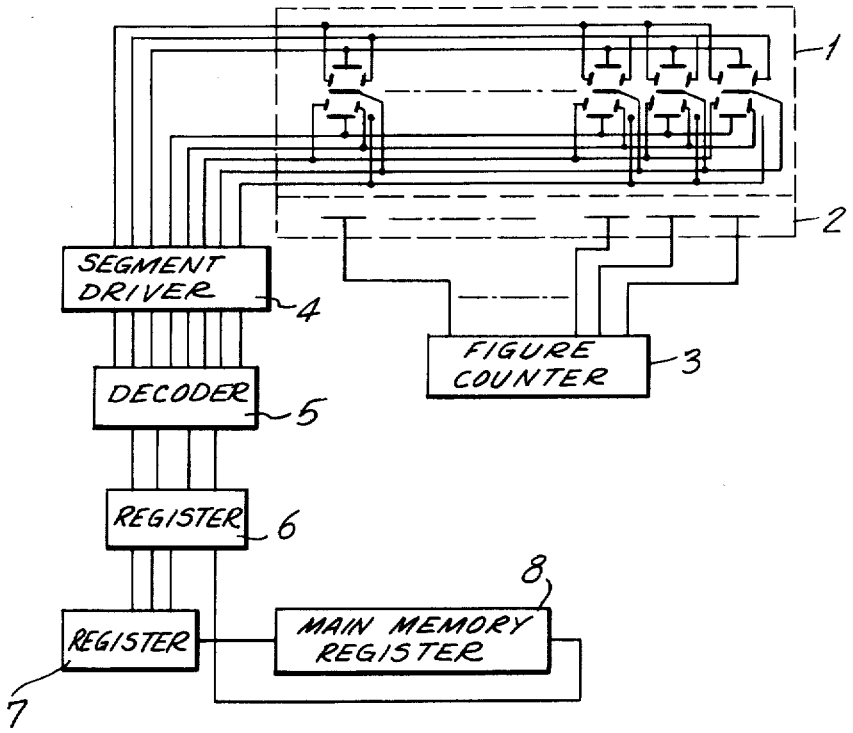
FIG. 1 PRIOR ART
FIG. 1 is a block diagram of a segmented fluorescent display and the arrangement for driving same.

Referring now to FIG. 1, a block diagram of a mosaic fluorescent display tube arrangement utilized in an electronic table computer or calculator is depicted. The arrangement includes a digital display 1 including segmented electrodes defining a multi-digit array of seven-bar displays, each digit being capable of displaying numbers from 0 to 9, and in addition, electrodes representative of decimal points. Each of the digits of the display 1 is provided with a common grid 2 which controls the sequential scanning of the respective digits in response to the output of figure counter 3. In other words, each of the digits are sequentially energized.

The respective segments of the respective seven-bar displays of the digits are coupled together and connected in common to corresponding outputs of segment driver 4. By this arrangement, an output signal along a particular line output of segment driver 4 is applied to all of the corresponding segments of all of the digits. However, only the segment of the particular digit then energized by figure counter 3 is displayed. Eight output lines of segment driver 4 are depicted, corresponding to the seven segments of the seven-bar display and to the decimal point.

The display is to be used in conjunction with a device, such as an electronic table computer or calculator having a main memory register 8 which is periodically read and written. The contents of the main memory register are read therefrom in bit serial form by register 7, the three-bit output of register 7 being transformed into parallel signals of four bits by register 6. The four-bit signal is sufficient to cause a single digit to display the correct number, the four bit signal being decoded by decoder 5 into a form suitable for driving segment driver 4.

The system operates as follows. The sequential scanning of the respective digits by figure counter 3 and the application of driving signals by segment driven 4 permits the energization of selected segments of one digit position at a time. The scanning rate is sufficiently fast so that the eye of the viewer of the display detects a continuous display although the digits are each being flashed on and off in response to the contents of main memory register 8. The fluorescent display tube of FIG. 1 can be driven directly by the bit serial register 8 since it can be actuated within the read-write period of the main memory register. As used herein, the "direct driving" of the fluorescent tube by the main memory register refers to the generation of driving signals for the tube in response to the main memory register output, the only intervening circuitry being adapted to restructure the output into a form suitable for driving the fluorescent tube without the intervention of temporary memory or storage arrangements. Examples of such prior art direct driving of fluorescent or incandescent displays, generally referred to as multiplexed driving, are contained in an article entitled "Multiplex Operation Of Display Tubes," Electronic Engineering, page 64 (May, 1972) (in connection with RCA's Numitrons incandescent digital-display devices); an article entitled "Panel Displays For Numerical and Alphanumeric Readout are Described In Recent Application Notes," IEEE Spectrum, page 76 (December, 1970) (referring to Burroughs Corporation's 7 or 9-segment Panaplex digital, cold-cathode, gas-discharge display tube and Self-Scan dot-matrix alphanumeric display); and Burroughs Corporation's Application Notes entitled "Multiplexed Operation Of Nixie Tubes" (Bulletin No. N101), "Self-Scan Panel Display Subsystems Theory Of Operation" (Bulletin No. S104) and "Panaplex Numeric Panel Display Theory Of Operation" (Bulletin No. P 101A).

Figure 2:
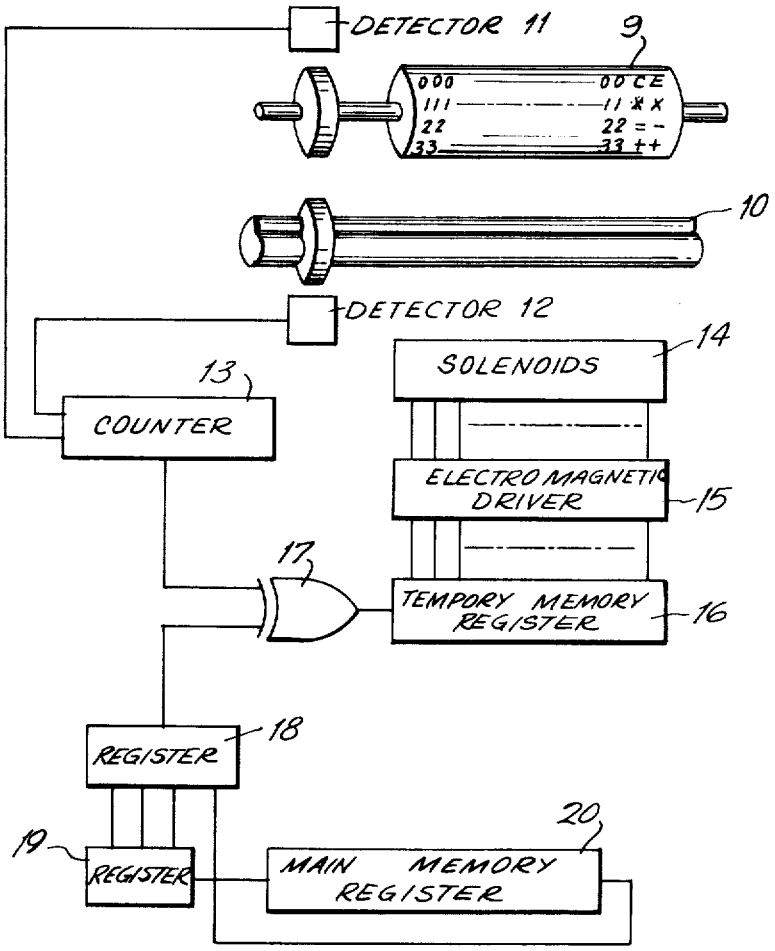
FIG. 2 PRIOR ART
FIG. 2 is a schematic and block diagram of a conventional line printer and the arrangement for driving same.

Referring now to FIG. 2, a conventional line printing device is depicted. The device includes a print drum 9 having an array of print digits aligned in circumferentially extending columns on the surface thereof. Printing is effected in this on-the-fly printer by means of a group of hammers, one of said hammers being provided for each column on the print drum. A continually rotating pawl 10 is provided for driving the hammers to effect printing. The selected hammers are displaced by solenoids 14 into the path of pawl 10 and are driven by said pawl so as to strike the desired number in the column associated with that hammer. Paper and a ribbon, or pressure-sensitive paper would be positioned intermediate the hammer and print roll. One standard position of print roll 9, which is also continuously rotating, is detected by detector 11 to provide reset pulses for synchronizing the position of the print drum with the input data. The position of pawl 10 is detected by detector 12 to produce timing pulses for the application of hammer driving signals.

The contents of main memory register 20 of the computer are read in bit serial form into a three-bit register 19 and applied in bit parallel form in a four-bit register 18, the four-bit signal stored in register 18 representing the data necessary for the printing of one figure in one column. Counter 13 is coupled to detectors 11 and 12 and is reset by the signal of detector 11 and counts in response to the signal of detector 12 to synchronize hammer driving timing. The output of register 18 and counter 13 are made to coincide by application to an EXCLUSIVE OR gate 17 to synchronize the timing of the printer and the computer. Coincident signals applied to gate 17 are applied to a temporary memory register 16 during each printing cycle, which is substantially slower than the read-right cycle of main memory register 20. The output of temporary memory register 16 drives electromagnetic drivers 15 which in turn drive selective solenoids 14 at points of time during each cycle such that the desired figure or symbol is printed in each column during the cycle to produce a line of printing. If printing is started at an arbitrary position of print roller 9, additional circuitry must be provided for detecting the completion of a single revolution of said print roller. The foregoing arrangement, unlike the arrangement of FIG. 1, requires the provision of the temporary memory register 16 and the driving timing counter 13 in order to effect printing.

Figure 3:
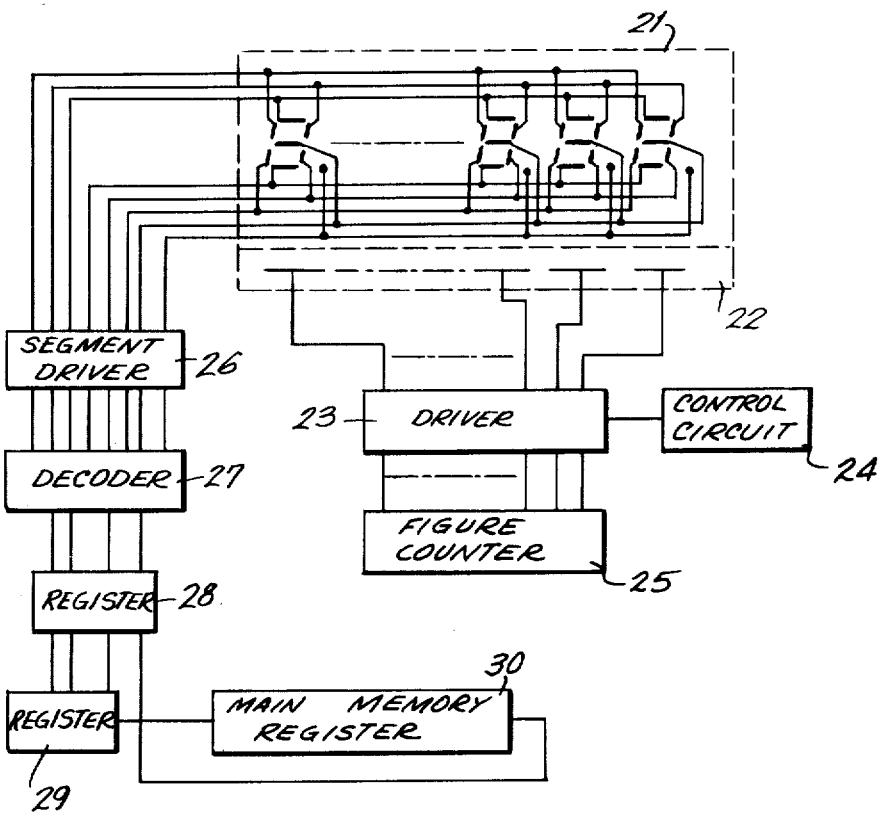
FIG. 3 is a block diagram of one embodiment of the dynamically driven printer in accordance with the invention incorporating thermo-sensitive print means.

A first embodiment of a dynamically driven printer in accordance with the invention is depicted in FIG. 3, wherein the print means is a thermosensitive printer. Said print means includes a print head 21 wherein each of the digits to be printed and intervening decimal points are represented by segmented heating elements, the numerals being represented by a seven-bar display defined by said heating elements. The thermoemissive elements of each digit defining said segments and decimal point are connected to a common electrode 22, one of said common electrodes being provided for each digit. The common electrodes 24 are connected to a sequential driver 23, in turn driven by a figure counter 25 which sequentially energizes the common electrode 22 associated with each digit. The respective thermoemissive elements of each digit are connected together and coupled to a segment driver 26 which applies common driving signals. As in the case of the circuit of FIG. 1, the output of main memory register 30 is applied in bit serial formed to register 29 which applies a three-bit signal to register 28 which produces a signal representative of a single digit in four bits for application to decoder 27 which, in turn, actuates segment driver 26. The printer of FIG. 3 operates in substantially the same manner as the display of FIG. 1 in that each of the digits are sequentially actuated by rendering the common terminal 22 conductive, only those thermoemissive elements of that digit to which power is applied from segment driver 26 being heated. Heating and radiation are balanced after several cycles to bring the arrangement to saturation and to effect printing on thermo-sensitive paper. After printing is completed, the common electrodes are turned off through the operation of control circuit 24 acting through driver 23. If head 21 is manually pressed to the thermo-sensitive paper, control circuit 24 is unnecessary. The print means of FIG. 3 may also be driven by applying a pulse current to the selected segment until thermal saturation and the head is then pressed against the thermo-sensitive paper at a desired time. Each segment of each digit would then be driven until the data is changed.

Figure 4:
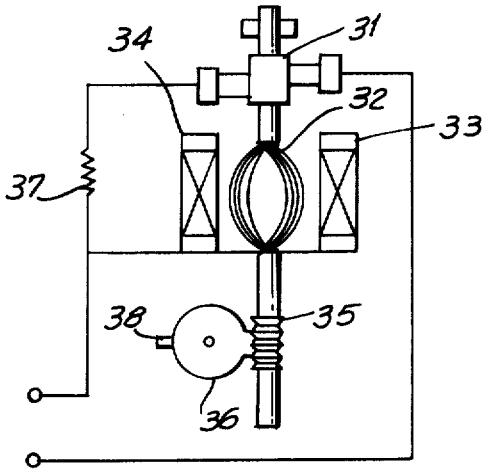
FIG. 4 is a schematic representation of a mechanical print means in accordance with the invention.

Another embodiment of the arrangement in accordance with the invention is depicted in FIG. 4 which shows a mechanical printer embodiment. Specifically, a rectifier-electromotive integrating wattmeter is utilized to transduce electric signals into mechanical signals. The transduced mechanical signals can be used in a printing arrangement such as a dot printer. In the embodiment of FIG. 4, a fixed current coil 33, 34 generates a magnetic field in proportion to a load current. An armature 32 is provided within the magnetic field thus generated and electric current flows through a rectifier 31 and direct current resistor 37. A driving torque proportional to the load power is applied to armature 32 in accordance with the interaction of coils 33 and 34 to rotate armature 32. The rotary torque is transmitted to a gear 36 through worm gear 35. 36 is the mechanical drive for the segments, dots or selected characters to effect printing. When the mechanism connected to gear 36 is moved to a print pattern forming position in one or several periods of the memory register, gear 36 may be stopped by a stopper. In other versions, a mechanism wherein a load backlashing force and an average electric power generated by integrating data is kept in balance is provided to maintain gear 36 in position even if current flows through rectifier 31 or resistor 37 after positioning. Printing is effected, for example, by providing a dot pin 38 at a stop position of gear 36 which presses a platen. When data is changed, a reset pawl is released to permit operation of gear 36 or to place the gear in a reset position for repositioning in response to the nextapplied data.

Figure 5A:
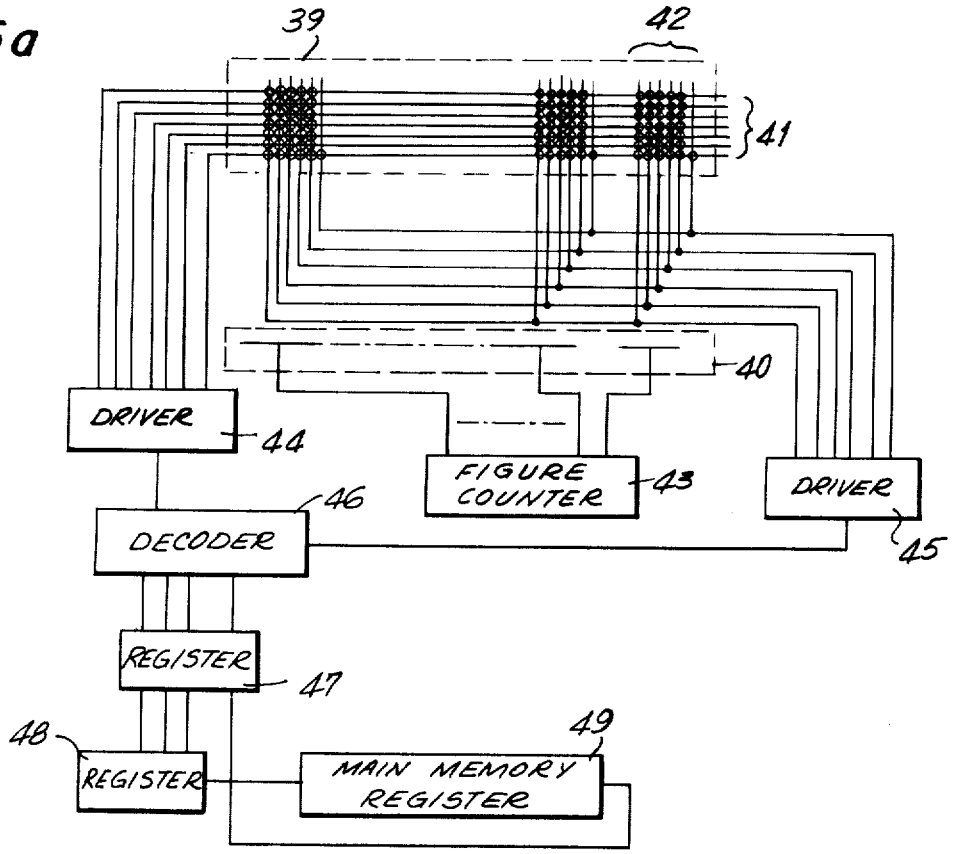
FIG. 5*a* is a schematic diagram of another embodiment of the dynamically driven printer in accordance with the invention utilizing a ferromagnetic dot printer.
Figure 5B:
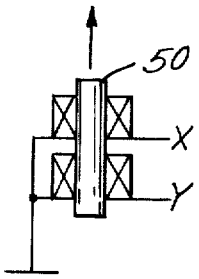
FIG. 5*b* is a schematic view of a printing element of the print means of FIG. 5*a*.

Still another embodiment of the dynamically driven printer in accordance with the invention is depicted in FIG. 5*a*, using a print means formed from ferromagnetic printing elements. The print head 39 is provided with a plurality of digits, each digit being represented by an array of ferromagnetic elements, in the form of pins, the array for each digit including five by seven dots per figure plus a dot for a decimal point. The pins are arrayed at the intersection of X-axes 41 and a common Y-axis 42. As more particularly shown in FIG. 5*b*, each ferromagnetic pin 50 is provided with a pair of coils, one coil being electrically connected to the corresponding Y-axis, the other coil being connected to the corresponding X-axis. The ferromagnetic pin is permanently magnetized for positioning in response to the energization of the respective coils. When both the X-axis and Y-axis coil associated with a particular pin 50 is energized, then that pin is displaced outwardly in the direction of the arrow shown in FIG. 5*b* to effect printing. One side of each X and Y coil in each digit is connected to a common electrode 40, one such common electrode being provided for each digit. Said common electrodes are sequentially energized by a figure counter 43. Separate drivers 44 and 45 are provided for respectively driving the X-axis 41 and the Y-axis 42. All of the corresponding X-axes lines of pins are electrically connected together while all of the corresponding Y-axes lines are likewise electrically connected together for simultaneous driving.

The output of main memory register 49 is applied in bit serial form to register 48 which produces a three-bit signal for application to register 47 in the manner described above. Decoder 46 is driven by register 47, also as described above.

Each ferromagnetic pin 50 is displaced when a signal is applied to both the X-axis and Y-axis coil and the common electrode 40 of that digit is energized. If a signal is applied to only one of the coils of a particular pin and the common electrode is energized, then the pin will move one-half of its normal displacement distance. Otherwise, the pin will not be displaced. Pin 50 is biased against displacement and returned to its original position upon the deenergization of the respective coils X and Y by any suitable known biasing means, in a manner well known in the prior art, one example of such biasing means being disclosed in U.S. Pat. No. 3,690,431. Printing is effected so that a print pattern formed by the pins of print head 39 define the digit or symbol to be printed. The pins can engage an ink roller or the like moving at low speed. Each pin can be made to touch the ink roller more than once at each position due to the relative sequencing speed of the pins, as compared to the speed of the ink roller. Analogous devices could be utilized by the substitution of electrostrictive material or material whose coefficient expansion is large in response to temperature differentials in place of the ferromagnetic material.

While specific print means have been depicted for carrying out the method in accordance with the invention, this application is not limited to the specific print means depicted, other print means capable of printing in response to direct driving by the contents of a memory register being capable of use. Such print means may include mechanical, thermo-sensitive, discharge, electrolytic, ink jet, ferromagnetic, electro-strictive, and supersonic wave type print means and the like. This arrangement effects substantial price savings through simplifying components. The arrangement in accordance with the invention offers the following advantages:

1. A temporary memory register used for selecting characters is unnecessary.

2. The circuitry, in the form of LSI or the control portion of a CRT or the like, developed for the electronic display arrangement of an electronic computer can be utilized to drive a print means in accordance with the invention.

3. Where both electronic display and printed display outputs to an electronic computer are to be provided, common driving methods can be utilized, resulting in lower cost.

4. When a printer is saturated by the application of more than a certain number of repetitions of the signal, it is not necessary to control the time of the signals for selecting characters.

5. When a printer is saturated by a certain repetition of signals, it is not necessary to provide a clock for the printer synchronized with that of the computer. Specifically, the printer in accordance with the invention can operate out of synchronization with the computer.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A dynamically driven printer for use with a device having a main memory register means and means for periodically reading from said main memory register means at a predetermined frequency, comprising print means; and means coupling said main memory register means and said print means for intermittently applying the contents of said main memory register means to said print means at said predetermined frequency, said print means being adapted to effect printing in response to the signals applied thereto by said coupling means in response to the contents of said main memory register means, said print means including a plurality of digit positions each including a plurality of segment printing devices connected to said coupling means, selected combinations of said segment printing devices at each digit position, when energized, producing selected characters for printing, each of said segment printing devices including a ferromagnetic pin, an X-axis coil and a Y-axis coil, each said coil having a first and second terminal, each digit position including a rectangular array of said segment printing devices aligned along X and Y axes, the first terminal of the corresponding lines of X-axis coils of the respective digit positions being electrically connected to receive the same driving signals from said coupling means, the first terminals of the corresponding lines of Y-axis coils of the respective digit position being connected together to receive the same driving signals from said coupling means; the second terminals of the coils of each digit position being commonly connected, and including means coupled to the common connection of each digit position for sequentially closing the circuits of the coils of each digit position, the ferromagnetic pins of each segment printing device being selectively displaced to effect printing upon the energization of the X-axis and Y-axis coils associated with that pin and the simultaneous closing of the circuits of the coils of the digit position associated therewith, whereby printing is effected in response to the contents of said main memory register.

2. A dynamically driven printer as recited in claim 1, wherein said coupling means includes driver means respectively connected to each of said X-axis and Y-axis coils and decoder means for converting the format of the contents of said main memory register means into a form suitable for energizing the respective driver means.

3. A dynamically driven printer, for use with a device having a main memory register means and means for periodically reading from said main memory at a predetermined frequency, comprising print means; and means coupling said main memory register and said print means for repetitively and intermittently applying the contents of said main memory register means to said print means, said print means being adapted to effect printing in response to the accumulated repetitive signals applied thereto by said coupling means in response to the contents of said main memory register means.

4. A dynamically driven printer as recited in claim 3, wherein said print means includes a plurality of segment printing devices connected to said coupling means for selective energization thereby, selected combinations of said segment printing devices, when energized, producing selected characters for printing.

5. A dynamically driven printer as recited in claim 4, wherein said print means includes a plurality of digit positions each including a plurality of segment printing devices, corresponding segment printing devices at each digit position being coupled together for simultaneous energization by said coupling means, and including means for sequentially energizing each of said digit positions so that only one of said digit positions is energized during the application of signals representing a single character to said segment printing devices by said coupling means.

6. A dynamically driven printer as recited in claim 5, wherein said segment printing devices are thermoemissive elements.

7. A dynamically driven printer as recited in claim 5, wherein said segment printing devices are ferromagnetic pins and coil means for selectively displacing each such pin coupled to said coupling means.

8. A dynamically driven printer as recited in claim 7, wherein each of said coil means includes an X-axis coil and a Y-axis coil, each digit position including a rectangular array of said segment printing devices aligned along X and Y axes; the corresponding line of X-axis coils of the respective digit positions being electrically connected to receive the same driving signals from said coupling means, the corresponding lines of Y-axis coils of the respective digit positions being connected together to receive the same driving signals from said coupling means, said coupling means including driver means respectively connected to each of said X and Y coils and decoder means for converting the format of the contents of said main memory register means into a form suitable for energizing the respective driver means.

9. A dynamically driven printer as recited in claim 8, wherein each of said coils has first and second terminals, the first terminals of the corresponding line of X-axis coils of the respective digit positions being electrically connected to receive the same driving signals from said coupling means and the first terminals of the corresponding line of Y-axis coils of the respective digit positions being connected together to receive the same driving signals from said coupling means; the second terminals of the X-axis and Y-axis coils of each digit position being connected together, said means for sequentially energizing each of said digit positions being coupled to the common connection of the second terminals of the coils of each digit position for sequentially closing the circuits of the coils of each of said digit positions.

10. A dynamically driven printer as recited in claim 5, wherein said coupling means includes circuit means for transforming the format of the contents of said main memory register means into a form suitable for driving said print means.

11. A dynamically driven printer as recited in claim 3, wherein said coupling means includes circuit means for transforming the format of the contents of said main memory register means into a form suitable for driving said print means.

12. A dynamically driven printer as recited in claim 3, wherein said print means includes a displaceable print element selectively positionable in a print position in response to the cumulative effect of the repetitive electrical signal applied thereto.

* * * * *